US007275954B2

(12) United States Patent
Ikenaga et al.

(10) Patent No.: US 7,275,954 B2
(45) Date of Patent: Oct. 2, 2007

(54) CONNECTOR ESTABLISHING A STABLE CONNECTION BETWEEN A CONTACT OF THE CONNECTOR AND A CONNECTION OBJECT

(75) Inventors: Naofumi Ikenaga, Tokyo (JP); Takaaki Kudo, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/285,869

(22) Filed: Nov. 23, 2005

(65) Prior Publication Data

US 2006/0110950 A1 May 25, 2006

(30) Foreign Application Priority Data

Nov. 24, 2004 (JP) ..... 2004-339427

(51) Int. Cl.
*H01R 12/24* (2006.01)

(52) U.S. Cl. ..... 439/494

(58) Field of Classification Search ..... 439/260, 439/495, 494, 492, 499, 67, 326, 327, 328, 439/329

See application file for complete search history.

(56) References Cited

U.S. PATENT DOCUMENTS 6,471,541 B2 * 10/2002 Kunishi et al. ..... 439/495
6,755,682 B2 * 6/2004 Kunishi et al. ..... 439/495
6,837,740 B2 * 1/2005 Kunishi et al. ..... 439/495
7,052,300 B2 * 5/2006 Okita et al. ..... 439/260
2002/0045374 A1 * 4/2002 Kunichi et al. ..... 439/260
2002/0081884 A1 * 6/2002 Asai ..... 439/260
2003/0157829 A1 * 8/2003 Kunishi et al. ..... 439/495
2005/0118849 A1 * 6/2005 Okita et al. ..... 439/260
2005/0260885 A1 * 11/2005 Lu ..... 439/495

FOREIGN PATENT DOCUMENTS

| | | |
|---|---|---|
| CN | 128476 | 2/2001 |
| CN | 1168184 C | 9/2004 |
| JP | 9097655 | 4/1997 |
| JP | 2001076794 | 3/2001 |

* cited by examiner

*Primary Examiner*—Chandrika Prasad
(74) *Attorney, Agent, or Firm*—Collard & Roe, P.C.

(57) ABSTRACT

In a connector including first and second contacts to be connected to a connection object and a housing holding the first and the second contacts, an actuator has a cam movable with respect to the housing between a connecting position of the connection object and a disconnecting position of the connection object. The first contact has a first contacting portion with a first contact point and a pivot portion operated by the cam. The second contact has a second contacting portion with a second contact point and a butting portion faced to the second contacting portion. The butting portion clamps the connection object in cooperation with the first contact point when the connector is connected to the connection object.

5 Claims, 6 Drawing Sheets

CONNECTOR ESTABLISHING A STABLE CONNECTION BETWEEN A CONTACT OF THE CONNECTOR AND A CONNECTION OBJECT

This application claims priority to prior Japanese application JP 2004-339427, the disclosure of which is incorporated herein by reference.

BACKGROUND OF THE INVENTION

This invention relates to a connector to be connected to a flexible printed circuit board (FPC) or the like.

A connector of the type is disclosed, for example, in Japanese Unexamined Patent Application Publication (JP-A) No. H9-97655. Referring to FIGS. 1 and 2, the connector will be described.

The connector depicted at 21 in the figures comprises a number of first contacts 23 held by a housing 22 and arranged adjacent to and in parallel to one another at a predetermined pitch to form a single row in a direction perpendicular to a drawing sheet. Similarly, a number of second contacts 24 are held by the housing 22 and arranged adjacent to and in parallel to one another at a predetermined pitch to form a single row in the direction perpendicular to the drawing sheet. The connector 21 also comprises an actuator 25 held by the housing 22 to be rotatable in a range of 90 degrees. FIG. 1 shows the actuator 25 in an opened position. FIG. 2 shows the actuator 25 in a closed position.

Each of the first contacts 23 has a pivot portion 23*a* elastically deformable, a contacting portion 23*b* faced to the pivot portion 23*a*, a connecting portion 23*c* connected to the pivot portion 23*a* and the contacting portion 23*b*, a fixing portion 23*d* connected to the connecting portion 23*c* and fixed to the housing 22, and a terminal portion 23*e* connected to the connecting portion 23*c*. The pivot portion 23*a* and the contacting portion 23*b* extend from the connecting portion 23*c* as two branched parts. The pivot portion 23*a* has an engaging recess 23*a*1 formed near its end to be engaged with a cam 25*a* at an end of the actuator 25. The contacting portion 23*b* has a contact point 23*b*1 formed near its end to be connected to a FPC 31. The actuator 25 has a recess 25*b* formed near the cam 25*a* at its end. FIG. 1 shows a state where the FPC 31 is inserted into the connector 21 and the actuator 25 is in the opened position.

The actuator 25 is rotated counterclockwise by 90 degrees from the opened position in FIG. 1 into the closed position in FIG. 2. In this event, the cam 25*a* pushes the pivot portion 23*a* upward so that the contact point 23*b*1 of the contacting portion 23*b* presses the FPC 31 in the direction depicted by the arrow. As a consequence, the housing 22 in contact with the FPC 31 is applied with a stress.

Another connector of the type is disclosed also in Japanese Unexamined Patent Application Publication (JP-A) No. 2001-76794.

In recent years, a connector is desired to have a low profile as one factor of a small size. However, if a housing (insulator) is reduced in thickness in order to achieve the low profile of the connector, a part of the insulator which is applied with a stress is easily deformable. This results in a disadvantage that connection between a contact of the connector and a connection object such as a FPC becomes unstable.

SUMMARY OF THE INVENTION

It is therefore an object of this invention to provide a connector capable of establishing stable connection between a contact of the connector and a connection object such as a FPC even if the connector has a low profile.

Other objects of the present invention will become clear as the description proceeds.

According to an aspect of the present invention, there is provided a connector comprising first and second contacts to be connected to a connection object, a housing holding the first and the second contacts, and an actuator having a cam movable with respect to the housing between a connecting position of the connection object and a disconnecting position of the connection object, the first contact having a first contacting portion with a first contact point and a pivot portion operated by the cam, the second contact having a second contacting portion with a second contact point and a butting portion faced to the second contacting portion, the butting portion clamping the connection object in cooperation with the first contact point when the connector is connected to the connection object.

DESCRIPTION OF THE PREFERRED EMBODIMENT

Figure 1:
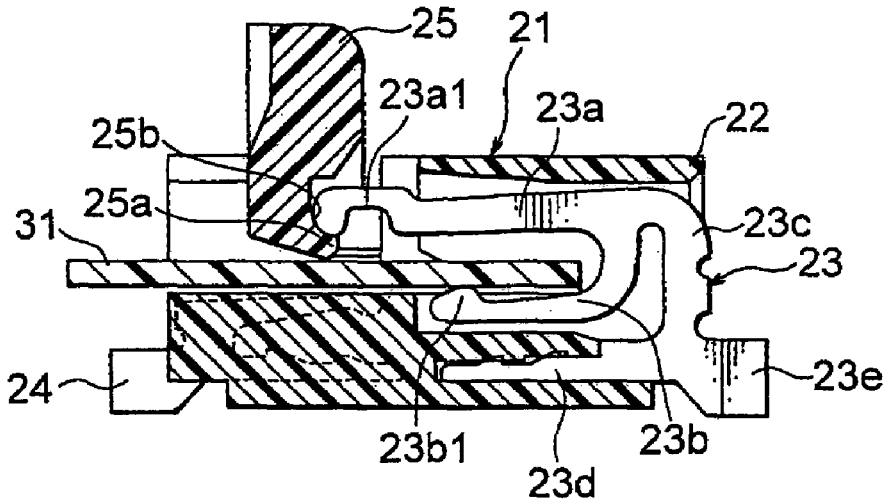
FIG. 1 is a sectional view of a conventional connector in a state where a FPC is inserted therein and an actuator is opened.
Figure 2:
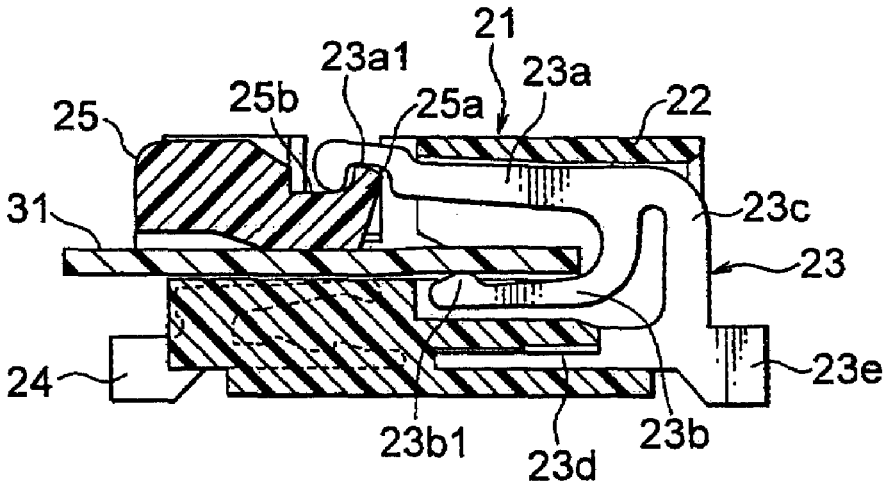
FIG. 2 is a sectional view of the connector in FIG. 1 in a state where the FPC is inserted therein and the actuator is opened.
Figure 3:
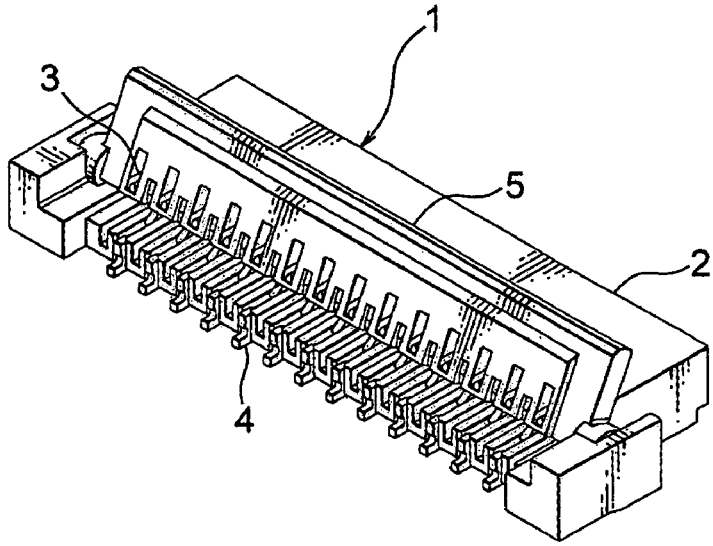
FIG. 3 is a perspective view of a connector according to an embodiment of this invention.
Figure 4:
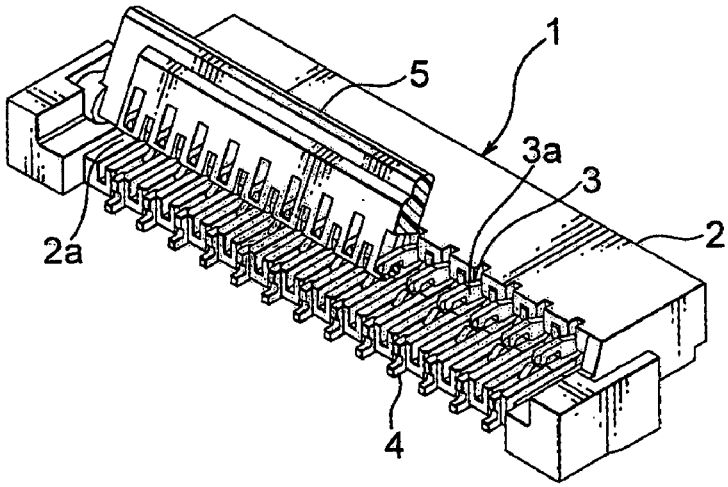
FIG. 4 is a perspective view of the connector in FIG. 3 with a part of an actuator cut away.
Figure 5:
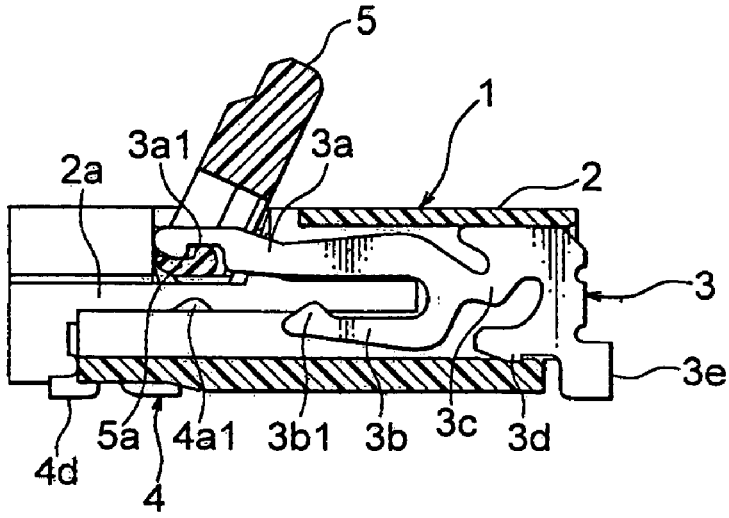
FIG. 5 is a sectional view of the connector in FIG. 3 at a position where a whole of a first contact is seen.
Figure 6:
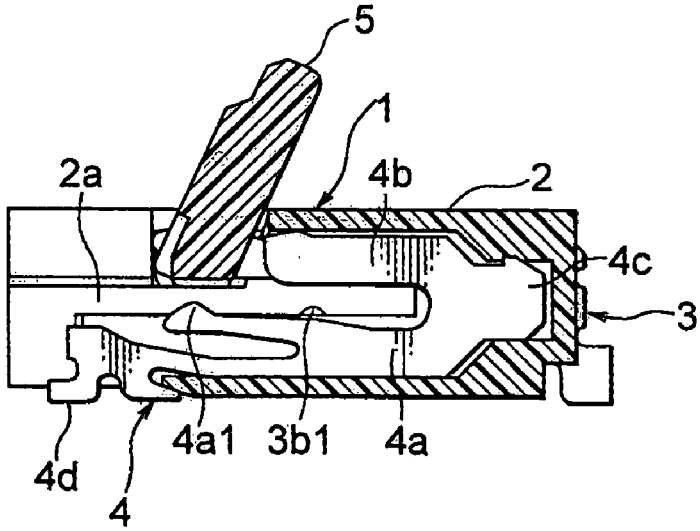
FIG. 6 is a sectional view of the connector in FIG. 3 at a position where a whole of a second contact is seen.

Referring to FIGS. 3 to 6, description will be made of a structure of a connector according to one embodiment of this invention.

The connector depicted at 1 in the figures comprises an insulating housing 2. The housing 2 holds a number of first contacts 3 arranged adjacent to and in parallel to one another at a predetermined pitch to form a single row and a number of second contacts 4 arranged adjacent to and in parallel to one another at a predetermined pitch to form a single row. The first and the second contacts 3 and 4 are alternately arranged. Each of the first contacts 3 has a pivot portion 3*a* exposed out of the housing 2.

The housing 2 holds an insulating actuator 5 which is movable between an opened position and a closed position by rotation in a predetermined angular range. In FIGS. 3 to 6, the actuator 5 is in the opened position. The housing 2 has an inlet 2*a* for insertion of a FPC 11 (see FIGS. 7 and 8) as a connection object. The opened position and the closed position will be referred to as a disconnecting position and a connecting position, respectively.

Each of the first contacts 3 is integrally formed from a conductive material and has a pivot portion 3*a*, a contacting portion 3*b* faced to the pivot portion 3*a*, a connecting portion 3*c* elastically deformable and connected to the pivot portion 3*a* and the contacting portion 3*b*, a fixing portion 3*d* connected to the connecting portion 3*c* and fixed to the housing 2, and a terminal portion 3*e* connected to the fixing portion 3*d*. The pivot portion 3*a* and the contacting portion 3*b* extend from the connecting portion 3*c* as two branched parts. The pivot portion 3*a* has an engaging recess 3*a*1 formed near its end to be engaged with a cam 5*a* of the actuator 5. The contacting portion 3*b* has a contact point 3*b*1 formed near its end to be connected to the FPC 11. More particularly, the contact point 3*b*1 of the first contact 3 is located at a position corresponding to the butting portion 4*b* of the second contact 4 in an inserting/removing direction in which the FPC 11 is inserted and removed.

Each of the second contacts 4 is integrally formed from a conductive material and has a contacting portion 4*a*, a butting portion or a receiving portion 4*b* faced to the contacting portion 4*a*, a connecting portion 4*c* connected to the contacting portion 4*a* and the butting portion 4*b*, a fixing portion 4*c* fixed to the housing 2, and a terminal portion 4*d* extending from an intermediate position of the contacting portion 4*a*. The contacting portion 4*a* has an elastically deformable portion which extends forward from the intermediate position and has a contact point 4*a*1 to be press contacted with the FPC 11. The contact point 4*a*1 is formed near an end of the contacting portion 4*a* to be connected to the FPC 11. More particularly, the contact point 4*a*1 of the second contact 4 is located at a position corresponding to the cam 5*a* of the actuator 5 in the inserting/removing direction. Therefore, the contact points 3*b*1 and 4*a*1 are located to form a staggered arrangement in a direction perpendicular to the inserting/removing direction.

The contacting portion 4*a* is faced substantially to the pivot portion 3*a* of the first contact 3. It is noted here that the first and the second contacts 3 and 4 are alternately fixed to the housing 2. More specifically, the first and the second contacts 3 and 4 are shifted in position to form a staggered arrangement.

The butting portion 4*b* is faced to the contacting portion 3*b* of the first contact 3. Similarly, the butting portion 4*b* and the contacting portion 3*b* are shifted in position to form a staggered arrangement.

Figure 7:
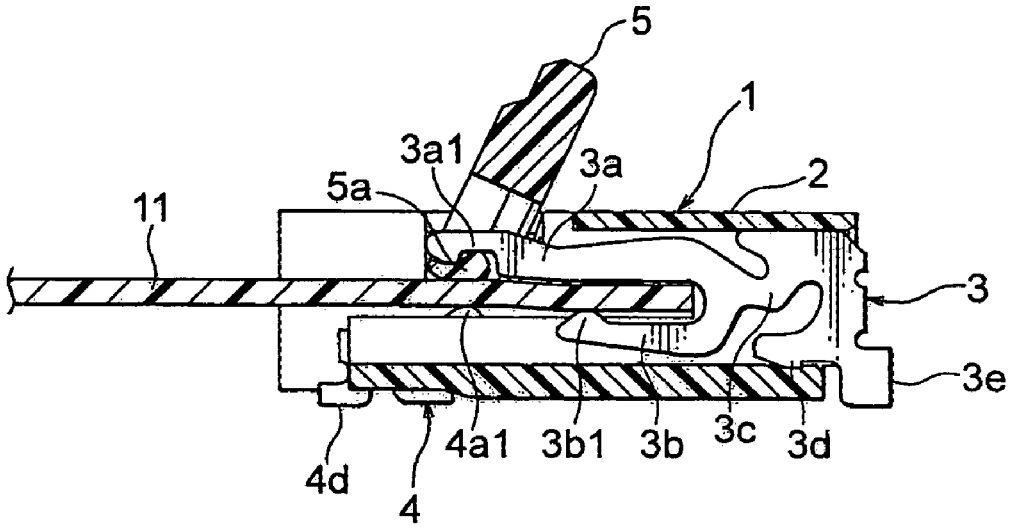
FIG. 7 is a sectional view similar to FIG. 5 in a state where a FPC is inserted into the connector.
Figure 8:
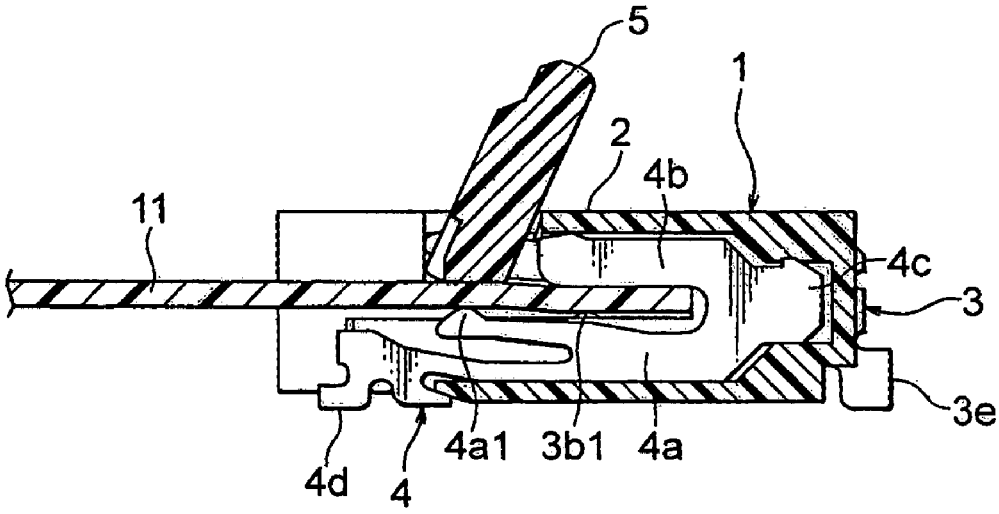
FIG. 8 is a sectional view similar to FIG. 6 in a state where the FPC is inserted into the connector.

Referring to FIGS. 7 and 8, the FPC 11 is inserted into the connector 1 and clamped between the butting portion 4*b* and the contact point 4*a*1 of the contacting portion 4*a*. At this time, the actuator 5 and the cam 5*a* are in the opened position. When the actuator 5 is rotated counterclockwise around the engaging recess 3*a*1, the actuator 5 is put into the closed position.

Figure 9:
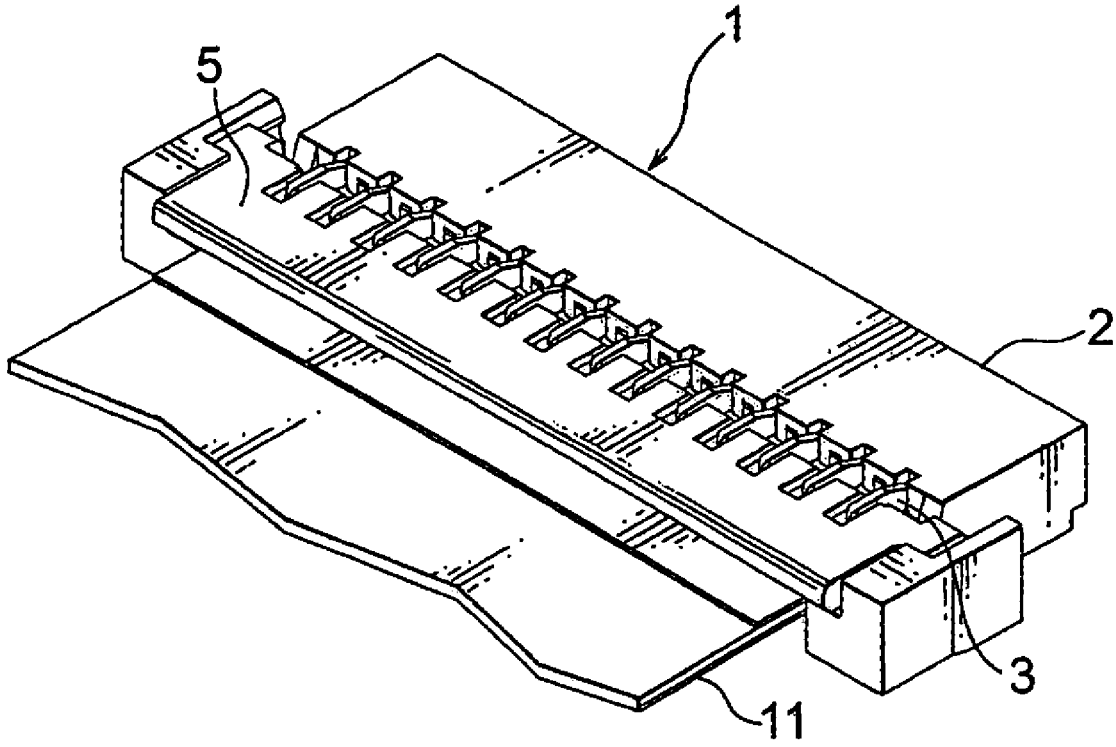
FIG. 9 is a perspective view of the connector in FIG. 3 in a state where the actuator is closed after the FPC is inserted into the connector.
Figure 10:
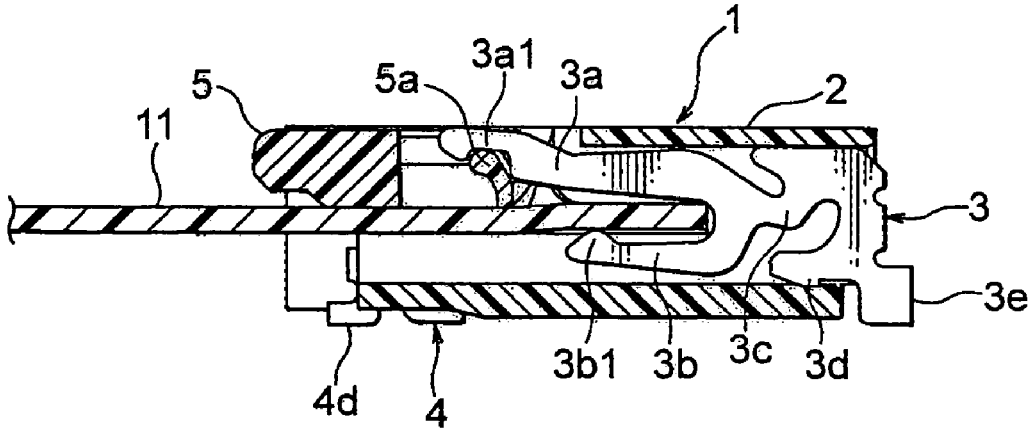
FIG. 10 is a sectional view similar to FIG. 7 after the actuator is closed.
Figure 11:
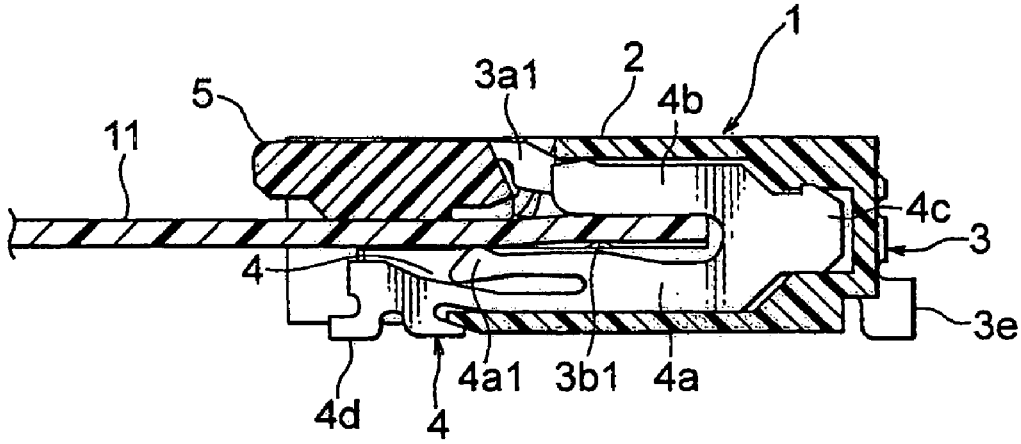
FIG. 11 is a sectional view similar to FIG. 8 after the actuator is closed.

Referring to FIGS. 9 to 11, the actuator 5 and the cam 5*a* are in the closed position. In this event, the cam 5*a* of the actuator 5 pushes the pivot portion 3*a* of the first contact 3 upward. As a consequence, in cooperation with the pivot portion 3*a*, the contact point 3*b*1 of the contacting portion 3*b* of the first contact 3 is press contacted with the FPC 11.

When the cam 5*a* of the actuator 5 is rotated counterclockwise, the FPC 11 is pushed downward. Then, the FPC 11 presses the contact point 4*a*1 of the second contact 4 so that the contacting portion 4*a* is elastically deformed from the position in FIG. 8 to the position in FIG. 11. In the state illustrated in FIG. 11, the butting portion 4*b* of the second contact 4 clamps the FPC 11 in cooperation with the contact point 3*b*1 of the first contact 3. The contact point 3*b*1 of the first contact 3 and the contact point 4*a*1 of the second contact 4 are reliably and stably connected to the FPC 11. Thus, when the actuator 5 is in the closed position, both of the contact points 3*b*1 and 4*b*1 of the first and the second contacts 3 and 4 are press contacted with the FPC 11.

The above-mentioned connector 1 can be reduced in profile without an increase in number of components. A force of pressing the FPC 11 by the contact point 3*b*1 of the first contact 3 is received by the butting portion 4*a*1 of the second contact 4. Therefore, deformation of the housing 2 can be suppressed. Thus, connection between the first and the second contacts 3 and 4 of the connector 1 and the FPC 11 is stable.

If the butting portion 4*b* of the second contact 4 and a butting portion of an inner wall of the housing 2 are designed to be flush with each other, deformation of the butting portion of the inner wall of the housing 2 can be suppressed further.

While this invention has thus far been described in conjunction with the preferred embodiment thereof, it will readily be possible for those skilled in the art to put this invention into practice in various other manners. For example, the actuator 5 may be modified in design to be linearly movable. It is a matter of course that this invention is applicable to a flexible flat cable (FFC) or the like.

What is claimed is:

1. A connector comprising:

first and second contacts to be connected to a connection object;

a housing holding the first and the second contacts, the connection object being adapted to be inserted into and removed from the housing in an inserting/removing direction; and an actuator having a cam and movable with respect to the housing between a connecting position of the connection object and a disconnecting position of the connection object, wherein:

the first contact comprises a first contacting portion with a first contact point, a pivot portion pivotally supporting the cam and operated by the cam, and a connecting portion which is elastically deformable to make the first contacting portion and the pivot portion be movable with respect to the housing, the second contact comprises a second contacting portion with a second contact point and a butting portion which is fixed to the housing and displaced from the cam in the inserting/removing direction, the second contact point faces the cam in a direction perpendicular to the inserting/removing direction, the first contact point faces the butting portion in a direction perpendicular to the inserting/removing direction, the connection object is inserted between the second contact point and the cam and between the first contact point and the butting portion, and when the actuator is moved from the disconnecting position to the connecting position, the cam moves the connection object and the pivot portion towards directions which are mutually away, whereby the connection object is clamped between the second contact point and the cam and between the butting portion and the first contact point.

2. The connector according to claim 1, wherein the first contact has a first fixing portion fixed to the housing, the connecting portion being connected between the first fixing portion and the pivot portion, the first contacting portion being connected to the pivot portion.

3. The connector according to claim 1, wherein the second contact point is movable with respect to the housing.

4. The connector according to claim 1, wherein the first contact and the second contact are arranged adjacent to and in parallel to each other.

5. The connector according to claim 1, wherein the pivot portion has a recess to be engaged with the cam.

* * * * *